United States Patent [19]

Horn

[11] 4,303,510

[45] Dec. 1, 1981

[54] OPERATING METHOD AND SETTLING MACHINE FOR PROCESSING COAL

[75] Inventor: Hannes S. Horn, Dortmund, Fed. Rep. of Germany

[73] Assignee: Klöckner-Humboldt-Deutz AG, Fed. Rep. of Germany

[21] Appl. No.: 126,988

[22] Filed: Mar. 3, 1980

[30] Foreign Application Priority Data

Mar. 2, 1979 [DE] Fed. Rep. of Germany ..... 2908229

[51] Int. Cl.[3] ..... B03B 5/12; B03B 5/18; B03B 5/20

[52] U.S. Cl. ..... 209/457; 209/427; 209/500

[58] Field of Search ..... 209/1, 427, 425, 423, 209/455–457, 500, 502

[56] References Cited

FOREIGN PATENT DOCUMENTS 594211 3/1934 Fed. Rep. of Germany ..... 209/427
968409 2/1958 Fed. Rep. of Germany ..... 209/1

OTHER PUBLICATIONS

Zimmerman, Batac JIG, Mining Congress Journal, May 1974, pp. 43–49.

*Primary Examiner*—Ralph J. Hill
*Attorney, Agent, or Firm*—Hill, Van Santen, Steadman, Chiara & Simpson

[57] ABSTRACT

A wet settling machine for processing mineral mixtures, particularly fine-grained coal and other minerals, has the separating liquid energized into a pulsating motion with a basic wave and an upper harmonic superimposed on the base wave. The harmonic wave may proceed longitudinally with respect to the base wave or transversely with respect to the base wave. The base wave is pneumatically generated and the harmonic wave is mechanically generated.

6 Claims, 3 Drawing Figures

OPERATING METHOD AND SETTLING MACHINE FOR PROCESSING COAL

BACKGROUND OF THE INVENTION

1. Field of the Invention

The present invention relates to a wet settling machine and an operating method for the machine for processing coal or other minerals, particularly fine-grained coal or minerals, in which the product layer to be processed is periodically lifted and lowered by the pulsating motion of a separating liquid.

2. Description of the Prior Art

In mechanically energized settling machines it is known, for example from the German Pat. No. 968,409, to superimpose a basic pulsation motion of the separating liquid with pulsations of a significantly smaller period by changes in the force effecting the jigging stroke or, separately therefrom, by other mechanical means, for example by means of an oscillating plate arranged in the separating chamber or by means of motions of the jig screen.

SUMMARY OF THE INVENTION

The object of the present invention is to improve on the known techniques for operating a wet settling machine and, in particular, to develop such techniques so that even large settling machines can be operated with superposed oscillations of the separating liquid.

The above object is achieved in that the pulse motion of the separating liquid is composed of a pneumatically generated base wave and a mechanically generated upper harmonic wave superposed on the base wave. By combining the known pneumatic pulsation generation of the base wave with the mechanical generation of the upper harmonic wave a particularly favorable excitation is advantageously employed for the respective individual pulsation. The base wave, at which large water masses are moved relatively slowly, is favorably generated pneumatically, whereas the upper harmonic wave, at which a higher excitation frequency is required and which can be limited to individual sections of the settling machine, is mechanically generated both simply and without significant expense. Further, the excitation air chambers offer an energy storage space in the lower part of the settling machine for the higher frequency pulsations.

In developing the invention, it is provided that the base wave and the upper harmonic wave proceed longitudinally with respect to one another. Given a longitudinal course, in which the wave fronts travel in the same plane, a fall path of the individual grains arises in a vertical plane without lateral deviations. This is advantageous for the separation of relatively homogeneous mixtures. Further, wear within the settling machine is also low.

It is provided in another development of the invention that the base wave and the upper harmonic wave travel transversely with respect to one another. In this embodiment, a particularly good intermixture and a particularly good neutralization of the frictional forces between the individual grains is achieved. The properties of the granulation bed approach those of a coarse-grained heavy liquid. Further, it is easily possible to spatially separate the pneumatic excitation of the base wave and the mechanical upper harmonic wave excitation from one another, so that a simple and fail-safe embodiment of the wet settling machine with transverse upper harmonic waves occurs.

In a further development of the invention, it is provided that the frequency of the upper harmonic wave corresponds to a multiple of the base wave frequency. By this provision, one advantageously avoids the occurrence of beats in the superposed waves, which beats would disadvantageously lead to wave fronts which regularly migrate through the granulation bed and unfavorably influence the uniformity of the separation.

For implementing the method of the invention, a settling machine is provided which has a pneumatically functioning device for generating the base wave and a mechanical device for generating the upper harmonic wave. With this structure, a settling machine is advantageously made available with which the method of the invention can be favorably implemented.

In developing the invention, it is provided that at least one of the sidewalls is movably designed in the area of the material layer and is connected with an oscillation generating system. With this structure, it can be advantageously and simply achieved, and without major structural changes of the known air-driven settling machines, that the base wave which is generated in the settling machine proceeding in a vertical direction is horizontally traversed by transverse waves.

It is further provided in a further development of the invention that the sidewalls below the material layer and/or the bottom of the settling machine are movably designed, particularly in the form of a membrane, and are connected to an oscillation generating system or that the upper harmonic wave generating elements which are adjustable in magnitude, particularly exhibit membranes and are connected to an oscillation and generating system and are arranged beneath the material layer. Due to these embodiments, it is advantageously possible to provide the most favorable upper harmonic wave generation for superposition proceeding longitudinally with respect to the base wave for the respective model and the respective area of application. For this purpose, the movable membranes in the floor and/or in the sidewalls are advantageous when relatively large upper harmonic waves are to be generated, whereas the upper harmonic wave generating elements beneath the material layer are suited for relatively small upper harmonic waves.

It is further provided that the supporting surface for the material layer is movably mounted, particularly capable of oscillation, and is connected to an oscillation generating system. With this structure, it is easily and simply possible to generate longitudinal upper harmonic waves of relatively high frequency, to which end the supporting surface for the material layer need only be mounted and driven in the manner of an oscillating screen.

It is provided in a further development of the invention that the oscillating plates parallel to the sidewalls are arranged in the material layer and are connected to an oscillation generating system. These oscillating plates can advantageously generate particularly intensive transverse waves. With this structure, a particularly easy and simple retrofit of existing machines is possible, since the suspension for the oscillating plates parallel to the sidewalls can be arranged above the machine, as can the oscillation generating system.

BRIEF DESCRIPTION OF THE DRAWINGS

Other objects, features and advantages of the invention, its organization, construction and modes of operation will be best understood from the following detailed description, taken in conjunction with the accompanying drawings, on which.

DESCRIPTION OF THE PREFERRED EMBODIMENTS

Figure 1:
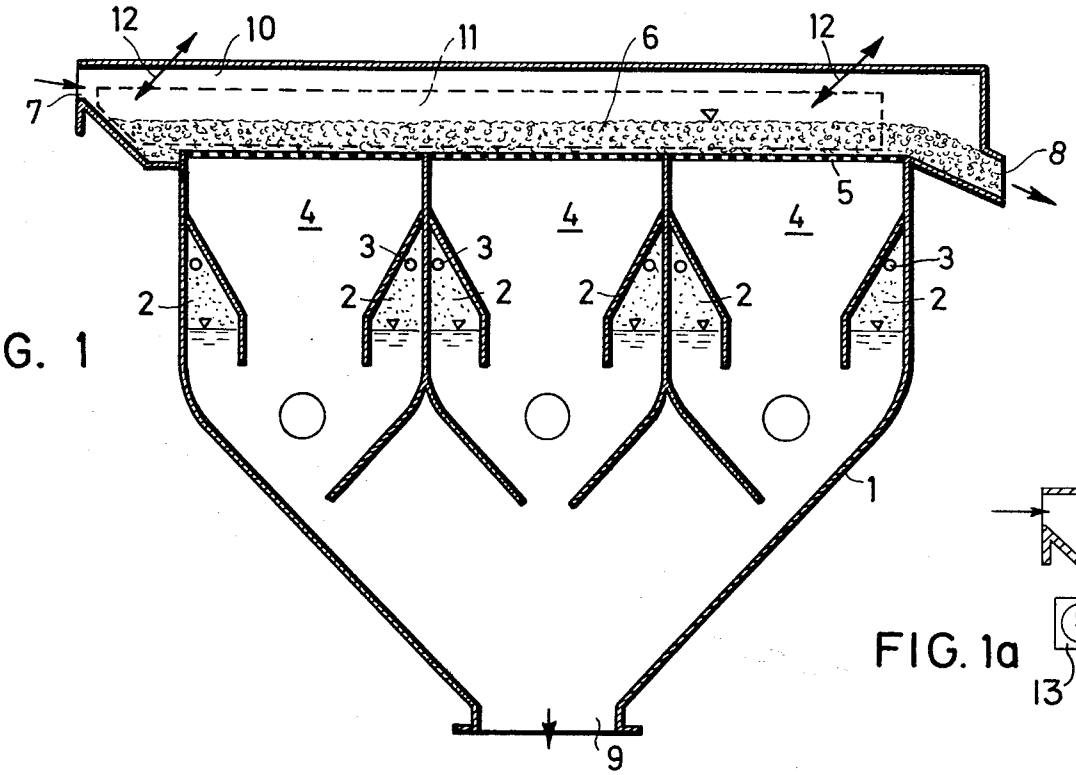
FIG. 1 is a longitudinal sectional view of a wet settling machine constructed in accordance with and operating in accordance with the present invention.

As illustrated in FIG. 1, excitation air chambers 2 having air intake/discharge openings 3 are arranged within the housing 1 of a settling machine at right angles to the longitudinal direction of the machine. The excitation air chambers 2 are respectively arranged at the walls of the individual settling or separating chambers 4 which extend at right angles across the width of the machine. The base wave is generated by means of rhythmic introduction into and the discharge of air from the excitation air chambers 2, as is well known in the art. This causes the separating liquid to pulsate up and down through the material to be separated. A jig screen 5 which carries the product 6 to be separated is located in the upper portion of the settling machine. The product traverses the settling machine from an intake 7 to a material discharge 8. Due to the rhythmic motions of the separating liquid, the lighter components are separated from the heavier components while the material passes through and the heavier components, insofar as no pivotal discharge need be provided, for example, for heavies (attle) or middlings, fall through the jig screen toward the bottom where the same are discharged through a product discharge 9. A bucket conveyor (not illustrated) is situated below the product discharge 9.

Figure 1A:
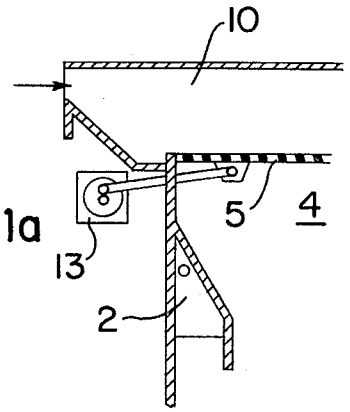
FIG. 1*a* is a fragmentary view of another embodiment of the invention having a vibratory jig screen.

Various alternatives for generating the upper harmonic waves may be employed in practicing the present invention. If one is to work with transverse waves, either the upper sidewall 10 in the area of the product layer 6 or oscillating plates 11 extending parallel to the sidewall 10, and indicated by broken lines, can be vibrated. The motion of the sidewall 10 or, respectively, of the oscillating plates 11, is indicated by the double-headed arrows 12. In the case of a longitudinally extending upper harmonic wave of small amplitude is to be achieved, it is most simple to place the jig screen in vibration, for example, by means of a mechanical excitation drive 13 illustrated in FIG. 1*a*. With this structure, the jig screen 5 is mounted on appropriate rubber thrust springs and is equipped with a vibration-resistant frame (not illustrated).

Figure 2:
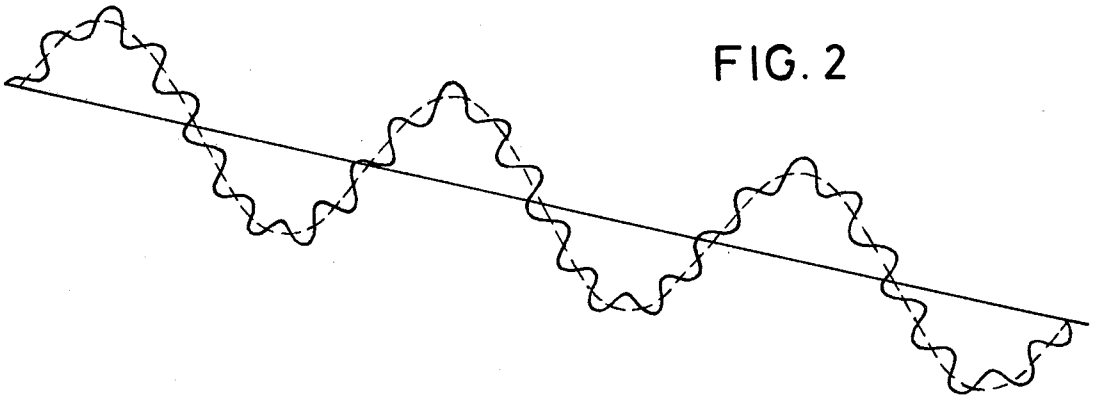
FIG. 2 is a graphic illustration of a longitudinal base wave and a superposed longitudinal harmonic wave.

As illustrated in FIG. 2, a superposed, higher frequency upper harmonic wave is superposed on the base wave and proceeds in the same direction as the base wave, the superposition being illustrated in the Y direction.

Figure 3:
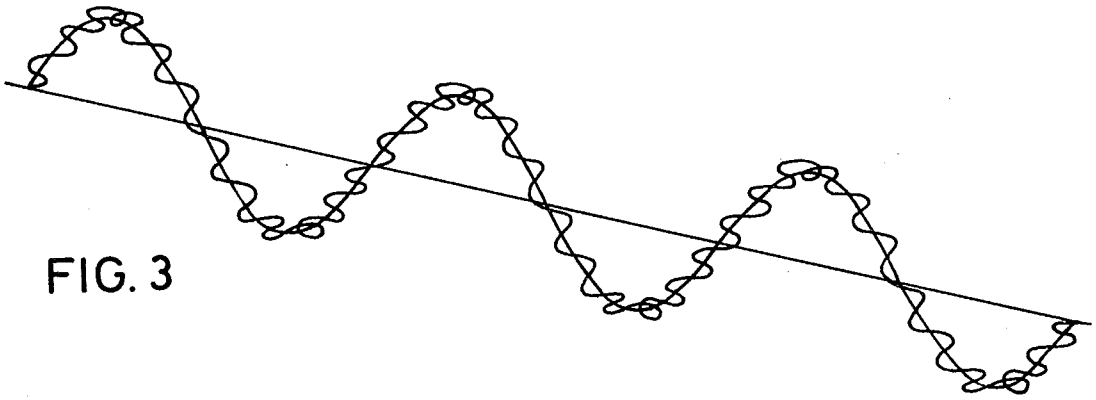
FIG. 3 is a graphic illustration of a longitudinal base wave and a superposed transverse harmonic wave.

In contrast thereto, a superposed, higher frequency upper harmonic wave is transversely superposed to proceed at right angles to the direction of motion of the base wave, as shown in FIG. 3. As a result, the granular material does not move in only a single plane, but, rather, in a spatial area and effects that the light material advantageously corresponds to the weighting agent of a heavy liquid. At the same time, the friction between the grains is reduced on all sides so that a significant improvement is obtained, particularly for difficult separating operations, for example, for slurry processing.

The invention discussed above is particularly suited for processing fine and superfine coal, for example, in slurry form. However, it can also be employed for processing other fine-grained minerals or even coarse-grained substances. Therefore, depending on the requirements, a suitable manner of generating the upper harmonic waves will be selected.

Although I have described my invention by reference to particular illustrative embodiments thereof, many changes and modifications of the invention may become apparent to those skilled in the art without departing from the spirit and scope of the invention. I therefore, intend to include within the patent warranted hereon all such changes and modifications as may reasonably and properly be included within the scope of my contribution to the art.

I claim:

1. In a method of processing mineral mixtures in which a layer of material to be processed travels from a material inlet to a material discharge on a jig structure over a separating liquid and is subjected to periodic pulsations of the separating liquid, which pulsations include a base wave and a superposed high frequency wave, the improvement therein comprising the steps of:

pneumatically generating the base wave in the separating chamber; and mechanically generating and superposing a harmonic of the base wave on the base wave at a point above the separating chamber in the area of the layer of the material to be processed by generating the higher frequency wave to proceed transversely with respect to the base wave.

2. In a method of processing mineral mixtures in which a layer of material to be processed travels from a material inlet to a material discharge on a jig structure over a separating liquid and is subjected to periodic pulsations of the separating liquid, which pulsations include a base wave and a superposed high frequency wave, the improvement therein comprising the steps of:

pneumatically generating the base wave in the separating chamber; and mechanically generating and superposing a harmonic of the base wave on the base wave at a point above the separating chamber in the area of the material to be processed by vibrating a vertical wall above the jig structure in the area of the layer.

3. In a method of processing mineral mixtures in which a layer of material to be processed travels from a material inlet to a material discharge on a jig structure over a separating liquid and is subjected to periodic pulsations of the separating liquid, which pulsations include a base wave and a superposed high frequency wave, the improvement therein comprising the steps of:

pneumatically generating the base wave in the separating chamber; and mechanically generating and superposing a harmonic of the base wave on the base wave at a point above the separating chamber in the area of the layer of material to be processed by vibrating an upper side wall of the machine housing above the jig structure in the area of the layer.

4. In a method of processing mineral mixtures in which a layer of material to be processed travels from a material inlet to a material discharge on a jig structure over a separating liquid and is subjected to periodic pulsations of the separating liquid, which pulsations include a base wave and a superposed high frequency wave, the improvement therein comprising the steps of:

pneumatically generating the base wave in the separating chamber; and mechanically generating and superposing a harmonic of the base wave on the base wave at a point above the separating chamber in the area of the layer of the material to be processed by vibrating a vertical plate which extends into the material layer.

5. In a wet settling machine of the type in which a layer of material to be processed travels from a material inlet to a material outlet on a jig structure over a separating chamber having a separating liquid therein and is subjected to periodic pulsations of the separating liquid, which pulsations include a base wave and a higher frequency wave superposed thereon, and in which the machine includes an upper vertical housing side wall in the area of the layer, the improvement therein comprising:

pneumatic generating means in the separating chamber for generating the base wave; and mechanical harmonic generating means, including a driver connected to the upper vertical wall for generating and superposing a harmonic of the base wave as the higher frequency wave on the base wave.

6. In a wet settling machine of the type in which a layer of material to be processed travels from a material inlet to a material outlet on a jig structure over a separating chamber having a separating liquid therein and is subjected to periodic pulsations of the separating liquid, which pulsations include a base wave and a higher frequency wave superposed thereon, the improvement therein comprising:

pneumatic generating means in the separating chamber for generating the base wave; and mechanical harmonic generating means, including a plate as a vibratory element disposed vertically and extending longitudinally in the direction of travel of the layer and vertically into the layer, and a driver connected to vibrate said plate.

* * * * *